United States Patent [19]

Walpin et al.

[11] Patent Number: 4,835,801

[45] Date of Patent: Jun. 6, 1989

[54] BACK SUPPORT CUSHION

[75] Inventors: Arline Walpin; Lionel A. Walpin, both of Los Angeles, Calif.

[73] Assignee: Roloke Co., Culver City, Calif.

[21] Appl. No.: 122,902

[22] Filed: Nov. 19, 1987

[51] Int. Cl.[4] ..... A47C 20/00; A47C 7/02

[52] U.S. Cl. ..... 5/432; 5/436; 297/460; 297/DIG. 1

[58] Field of Search ..... 5/432, 433, 436, 446; 297/460, DIG. 1

[56] References Cited

U.S. PATENT DOCUMENTS

| | | | |
|---|---|---|---|
| 1,917,264 | 7/1933 | Kellogg | 297/460 X |
| 2,647,560 | 8/1953 | Huebener | 297/460 X |
| 2,769,485 | 11/1956 | Shapiro | 297/DIG. 1 X |
| 4,535,495 | 8/1985 | Oldfield | 5/432 |
| 4,572,578 | 2/1986 | Perkins | 5/432 X |
| 4,696,519 | 9/1987 | Yeum | 297/460 X |

FOREIGN PATENT DOCUMENTS

| | | | |
|---|---|---|---|
| 957440 | 11/1974 | Canada | 5/432 |

*Primary Examiner*—Gary L. Smith
*Assistant Examiner*—Michael F. Trettel
*Attorney, Agent, or Firm*—Lyon & Lyon

[57] ABSTRACT

A back support cushion which provides neurosensory proprioceptive kinesthetics cues to the thoracic region of the spine in proximity to the apex of the thoracic curve of the spine and provides support in the vertical plane. The kinesthetic cues and vertical plane support is accomplished by shaping the face of a back cushion in such a manner that a relatively firm raised mound is formed in proximity to the area of the apex of the thoracic spine. Thus, when the person is seated, the firm raised mound provides a light pressure on the area of the thoracic spine's bony and soft tissue elements—which stimulates the neurosensory end organs located in the muscles, tendons, ligaments, joint capsules and periosteum of the thoracic spine.

3 Claims, 1 Drawing Sheet

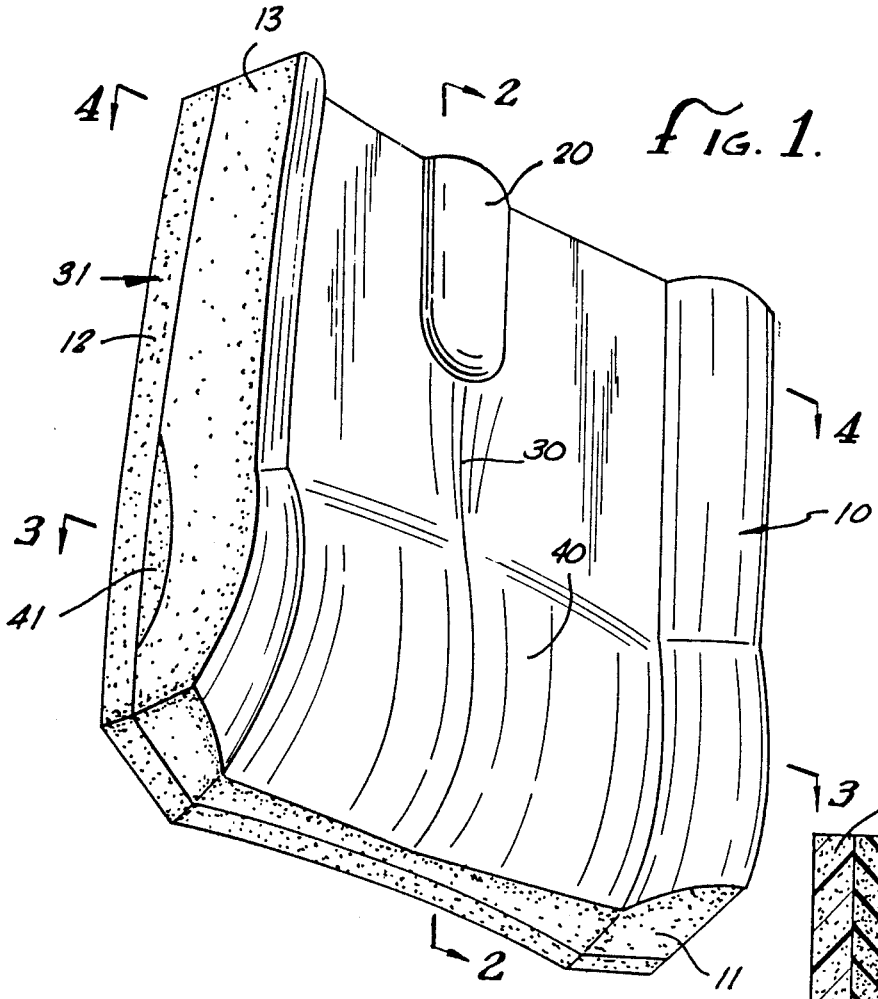
FIG. 1.
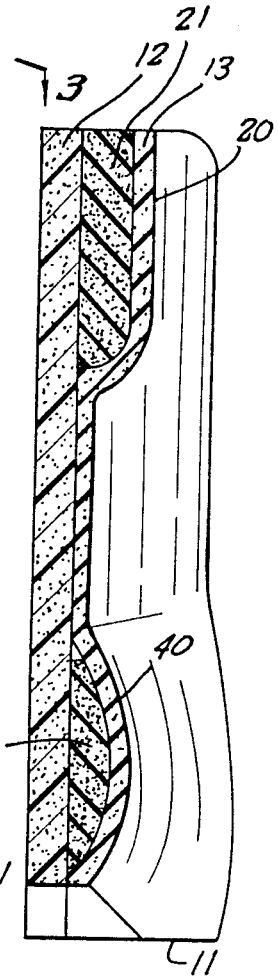
FIG. 2.
FIG. 4.
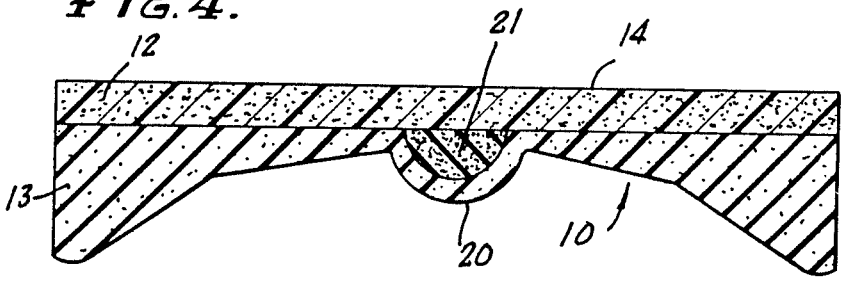
FIG. 3.
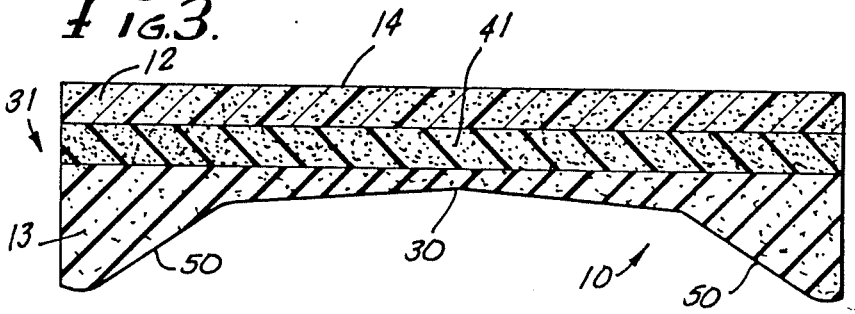

BACK SUPPORT CUSHION

BACKGROUND OF THE INVENTION

1. Field of the Invention

The field of the invention is support cushions for the back; more particularly, the field pertains to cushions for supporting the thoracic and lumbar regions of the back when the user is in the sitting position.

2. Prior Art

Cushions for providing support to the lumbar region of the back are relatively well-known. Examples of these can be found in some modern cars. The front seats in these cars now include a raised forward contour towards the bottom of the seat back. This raised portion pushes forward on the lumbar region of the user's back as the user leans back against it. Additionally, there are some variations of portable lumbar support cushions that are sold through medical supply houses and pharmacies that provide similar support for the lumbar region and may be employed in car seats and chairs that would not otherwise provide lumbar support. These lumbar support cushions provide a certain degree of support for the user's lumbar region. These prior art back support cushions and car seats may be in the form of tubular rolls; sometimes include a curved contour in the region of the users loins; and, some have moveable supports. The support provided by these prior art cushions, however, is limited to the sagittal, i.e., forward/backward plane in the case of the tubular rolls and those with moveable supports, and also in the horizontal plane in the case of those that include a curved contour in the region of the loins.

While the lumbar support cushions and contoured car seats provide a certain degree of support for the lumbar spine and the loin area, they are not, nor are any other known cushions also designed with a particular surface plane geometry that provides in combination: multiple differential neurosensory, proprioceptive and kinesthetic cues to the muscular, joint and bony elements of the back; a relief zone for the spinous processes of the vertebrae of the lumbar and thoracic portions of the spine; support and kinesthetic cues to the area immediately caudal and at the apex of the thoracic curve of the spine. Rather, the prior art cushions simply follow the major contours of the curves of the spine.

SUMMARY OF THE INVENTION

The present invention provides kinesthetic cues to the thoracic region of the spine in proximity to the apex of the thoracic curve of the spine and provides support to that area in the vertical plane. The kinesthetic cues and vertical plane support is accomplished by including a raised mound in the surface plane geometry of the face of a cushion in proximity to the area of the apex of the thoracic spine. Thus, when the user is seated, the raised mound provides a light pressure on the thoracic spine's bony and muscular elements which stimulates the neurosensory end organs located in the muscles, tendons, ligaments, joint capsules and periosteum of the thoracic spine. This neurosensory stimulation results in a beneficial reflex relaxation of the muscles located above the apex of the thoracic curve including the back of the neck. As a result, the user sits more lengthened with less joint compression and ligament tension which both cause and result from bad posture. Because of this the muscles below the thoracic curve's apex and the lumbar muscles can also relax. The kinesthetic cues offered by the contact points also increase the user's body awareness and body movement. Thus, the postural reference points on the surface of the device cause a voluntary improvement of sitting posture. Sitting posture also improves because of reflex neuromotor (neuro muscular) improvement in the postural balance of the supporting muscles around the spine. The body movement improves because the thoracic apex can roll forward and backward over the raised mound and the spine is generally in a more neutral balanced posture from cervical through lumbar.

The raised mound also serves as a small ledge to provide vertical support to the user in the region of the under surface of the apex of the thoracic curve of the spine. The unique raised mound also makes it unnecessary for the user to slump down or lean back specifically to make contact with the chair through the medium of the cushion as is the case with the prior art back support cushions. In fact, habitual slumped down and/or leaned back sitting postures are considered detrimental to body use. Thus, the net result is that the user of the present invention maintains better sitting posture at rest and during movement while sitting because the user sits taller "at ease" in a neutral and lengthened spinal posture wherein the back muscles are released and the spine is neither slumped or leaned back.

Another aspect of the present invention is that except for the raised mound the face of the cushion is shaped in such a manner to create a central trough which runs the length of the cushion. This central trough provides a structural relief for the backward projecting, pointed, spinous processes of the thoracic vertebrae to rest in, thus relieving pressure from these sensitive bony points. Thus, a user with painful tender spinous processes does not pull forward, away from the device to relieve painful pressure. At the same time the contour of the central trough creates slight pressure on the muscles directly adjacent to the spine resulting in a gentle massage of and kinesthetic cuing to the muscles adjacent the spine throughout the length of the lumbar spine and the thoracic spine.

Accordingly it is an object of the present invention to provide a back support cushion which provides a surface plane geometry which increases neurosensory kinesthetic cueing and provides vertical plane support to the region just below the apex of the thoracic curve of the spine and provides relief for painful tender spinous processes.

BRIEF DESCRIPTION OF THE DRAWINGS

FIG. 1 is a perspective view of a back support cushion embodying the present invention.

FIG. 2 is a view of the preferred embodiment depicted in FIG. 1 taken along plane 2—2.

FIG. 3 is a view of the preferred embodiment depicted in FIG. 1 taken along plane 3—3.

FIG. 4 is a view of the preferred embodiment depicted in FIG. 1 taken along plane 4—4.

DETAILED DESCRIPTION OF THE DRAWINGS

The preferred embodiment of the present invention is embodied in the back support cushion depicted in FIG. 1 and is comprised generally of a cushion with a contoured front face 10 and raised mound 20 formed in the central or spinal portion of the front face in a location that corresponds to the area near the apex of the thoracic curve of the spine of the user when the cushion is used behind a seated user. In the preferred embodiment the raised mound 20 is approximately 10 to 15 inches from the bottom edge 11 of the cushion. The preferred location of the raised or thoracic mound 20 was determined based upon the most common location of the apex of the thoracic curve of most seated adults. As would be apparent the precise location of the thoracic mound 20 can be tailored for a particular user. The preferred location for the maximum postural and comfort benefits has been found to be just below the apex. This location has been shown to provide the maximum support in the vertical plane of the user.

The cushion embodying the invention depicted in FIG. 1 also includes a back pad 12 and a front pad 13. In this configuration the thoracic mound 20 can be formed by bonding a first insert 21 between the front pad 13 and the back pad 12. The first insert 21 forms a raised mound on the surface of the front face 10 creating a unique surface plane geometry not found in prior art back support cushions. To optimize the formation of the thoracic mound 20 in this manner, the first insert 21 has a rectangular cross section.

The surface of the front face 10 of the cushion embodying the present invention is contoured to include a surface plane geometry having a central or spinal trough 30. The spinal trough 30 is formed to provide relief for the spinous processes of the user. In the cushion embodying the preferred embodiment the spinal trough extends from just below the thoracic mound 20 to the bottom edge 11. When the cushion is comprised of a front pad 13 and a back pad 12, the spinal trough 30 is preferably formed by providing the front pad 13 with a cross section having a decreasing thickness gradient from each of the side edges 31 which gradients converge at a low point in the central portion of the cushion. The decreasing thickness gradients also facilitate the formation of the thoracic mound 20. Since the front pad 13 becomes thinner in the central portion, the front face 10 will more easily take on a desirable curved contour in the area of the first insert 21. This also results in the first insert 21 creating the desired contour on the front face 10 while minimizing the distortion to the desirable substantially flat contour of the back face 14 of the back pad 12.

The surface plane geometry of the preferred embodiment includes a raised or lumbar strip 40 which extends the width of the cushion. The desired contour of the lumbar strip 40 on the front face 10 is achieved by bonding a second insert 41 between the front pad 13 and the back pad 12. The locational relationship between the lumbar strip 40 and the thoracic mound 20 is such that when the thoracic mound 20 is positioned at a point close to the apex of the thoracic curve of the spine, preferably just below the apex, the lumbar strip 40 is positioned so as to be substantially aligned with the lumbar region of the user's back. In the preferred embodiment the second insert is rectangular in cross section and the desired surface geometry and contour is achieved by controlling the thickness of the front pad 13. The most beneficial surface geometry and contour has been found to include a spinal trough 30 extending transversely across the lumbar strip 40. The spinal trough 30 relieves the pressure on the spinous processes of the lumbar spine while still providing pressure and lateral support to the lumbar region of the back.

The contour of the front face 10 of the cushion depicted in FIG. 1 includes raised side borders 50 in the broad back region of the cushion. These broad back contours run the length of the cushion and are contoured to conform with the general curvature of the back. The broad back contours or raised side borders 50 in combination with the lateral portion of the lumbar strip 40 are arranged to provide support to the loin region which is located between the lower or false ribs and the top of the ilium or pelvis. Support in this area is desirable because of the lack of skeleton (except for the centrally located spine) in this area, and the general paucity of large lateral muscles in this area. The broad back contours 50 of the preferred embodiment depicted in FIG. 1 are formed as an integral part of the front pad 13.

Thus, a back support cushion having a unique surface plane geometry for inter alia providing support to the thoracic portion of the spine in the vertical plane and lateral support to the broad back regions and the lower back when the cushion is placed behind the user in the sitting position has been described. While embodiments, applications and advantages of the invention have been shown and described, as would be apparent to ones skilled in the art, many more embodiments, applications and advantages are possible without deviating from the inventive concepts described herein. The invention, therefore, is not to be restricted except in accordance with the spirit of the appended claims.

We claim as follows:

1. A cushion comprised of a front pad, a back pad, a bottom edge and a first side edge and a second side edge, wherein a first insert is bonded between said front pad and said back pad located in a central portion of said cushion creating a raised mound in said front pad; a second insert between said front pad and said back pad extending the width of the pad forming a raised strip in the front pad below said raised mound; said front pad has decreasing cross sectional thickness gradients extending from said first side edge and said second side edge which thickness gradients converge in the central portion of said cushion to form a central trough which extends from said raised mound transversely across said raised strip to said bottom edge.

2. The cushion of claim 1 wherein said front pad includes raised side borders running the length of said front pad adjacent to said first and second side edges.

3. The cushion of claim 1 wherein said first and second inserts are rectangular in cross section.

* * * * *